US007536984B2

(12) United States Patent
Lou

(10) Patent No.: US 7,536,984 B2
(45) Date of Patent: May 26, 2009

(54) VARIABLE VALVE ACTUATOR WITH A PNEUMATIC BOOSTER

(75) Inventor: Zheng Lou, Plymouth, MI (US)

(73) Assignee: LGD Technology, LLC, Plymouth, MI (US)

( * ) Notice: Subject to any disclaimer, the term of this patent is extended or adjusted under 35 U.S.C. 154(b) by 0 days.

(21) Appl. No.: 11/787,295

(22) Filed: Apr. 16, 2007

(65) Prior Publication Data

US 2008/0251041 A1 Oct. 16, 2008

(51) Int. Cl.
*F01L 1/34* (2006.01)

(52) U.S. Cl. ..... 123/90.16; 123/90.15; 123/90.12

(58) Field of Classification Search ..... 123/90.11, 123/90.12, 90.16, 90.15; 137/906; 251/25; 91/356, 392, 508
See application file for complete search history.

(56) References Cited

U.S. PATENT DOCUMENTS 5,988,124 A * 11/1999 Duesmann ..... 123/90.11
6,543,225 B2 4/2003 Scuderi
2005/0132987 A1* 6/2005 Chang ..... 123/90.12

OTHER PUBLICATIONS

*Schuderi Group, L.L.C., Plaintiff* vs. *LGD Technology, LLC and Zheng (David) Lou, Ph.D., Defendents,* Civil Complaint, U.S. District Court, District of Massachusetts.

*Schuderi Group, LLC Plaintiff* v. *LGD Technology, LLC and Zheng (David) Lou, Ph.D., Defendents,* Answer to Complaint, Affirmative Defenses, Counterclaims and Jury Demand.

*Schuderi Group, LLC Plaintiff* v. *LGD Technology, LLC and Zheng(David) Lou, Ph.D., Defendents,* Answer to Defendent's Counterclaim and Affirmative Defenses.

* cited by examiner

*Primary Examiner*—Zelalem Eshete

(57) ABSTRACT

Actuators, and corresponding methods and systems for controlling such actuators, provide independent valve control with a large initial or opening force. In an exemplary embodiment, an actuator includes a driver further including a housing defining a longitudinal axis and first and second directions, an actuation mechanism capable of generating actuation force at least in the first direction, and a rod with one end operably connected with at least one part of the actuation mechanism and with the other end available for an operable connection with a load such as an engine valve; at least one return spring operably connected with the rod through a spring retainer assembly and biasing the rod in the second direction; and a pneumatic booster further including a pneumatic cylinder, a pneumatic piston operably connected with the rod through the spring retainer assembly and biasing the rod in the first direction, a charge mechanism providing a controlled fluid communication between the pneumatic cylinder and a high-pressure gas source, and a bleed mechanism providing a controlled fluid communication between the pneumatic cylinder to a low-pressure gas sink.

15 Claims, 5 Drawing Sheets

VARIABLE VALVE ACTUATOR WITH A PNEUMATIC BOOSTER

FIELD OF THE INVENTION

This invention relates generally to actuators and corresponding methods and systems for controlling such actuators, and in particular, to actuators offering efficient, fast, flexible control with large opening forces.

BACKGROUND OF THE INVENTION

A split four-stroke cycle internal combustion engine is described in U.S. Pat. No. 6,543,225. It includes at least one power piston and a corresponding first or power cylinder, and at least one compression piston and a corresponding second or compression cylinder. The power piston reciprocates through a power stroke and an exhaust stroke of a four-stroke cycle, while the compression piston reciprocates through an intake stroke and a compression stroke. A pressure chamber or cross-over passage interconnects the compression and power cylinders, with an inlet check valve providing substantially one-way gas flow from the compression cylinder to the cross-over passage, and an outlet or cross-over valve providing gas flow communication between the cross-over passage and the power cylinder. The engine further includes an intake and an exhaust valve on the compression and power cylinders, respectively. The split-cycle engine according to the referenced patent and other related developments potentially offers many advantages in fuel efficiency, especially when integrated with an additional air storage tank interconnected with the cross-over passage, which makes it possible to operate the engine as an air hybrid engine. Relative to an electrical hybrid engine, an air hybrid engine can potentially offer as much, if not more, fuel economy benefits at much lower manufacturing and waste disposal costs.

To achieve the potential benefits, the air or air-fuel mixture in the cross-over passage has to be maintained at a predetermined firing condition pressure, e.g. approximately 270 psi or 18.6 bar gage-pressure, for the entire four stroke cycle. The pressure may go much higher to achieve better combustion efficiency. Also, the opening window of the cross-over valve has to be extremely narrow, especially at medium and high engine speeds. The cross-over valve opens when the power piston is at or near the top dead center (TDC) and closes shortly after that. The total opening window in a split cycle engine may be as short as one to two milliseconds, compared with a minimum period of six to eight milliseconds in a conventional engine. To seal against a persistently high pressure in the cross-over passage, a practical cross-over valve is most likely a poppet or disk valve with an outward (i.e. away from the power cylinder, instead of into it) opening motion. When closed, the valve disk or head is pressured against the valve seat under the cross-over passage pressure. To open the valve, an actuator has to provide an extremely large initial opening force to overcome the pressure force on the head as well as the inertia. The pressure force drops dramatically once the cross-over valve is open because of a substantial pressure-equalization between the cross-over passage and the power cylinder. Once the combustion is initiated, the valve should be closed as soon as desired to prevent the spread of the combustion into the cross-over passage, which also entails, during a certain period of combustion, a need to keep the valve seated against a power cylinder pressure that is higher than the cross-over passage pressure. In addition, the cross-over valve needs to be deactivated when the power stroke is not active in certain phases of the air hybrid operation. Like conventional engine valves, the seating velocity of the cross-over valve has to be kept under a certain limit to reduce noise and maintain adequate durability.

In summary, a cross-over valve actuator has to offer a large initial opening force, a substantial seating force, a reasonably low seating velocity, a high actuation speed, and timing flexibility while consuming minimum energy by itself. Most, if not all, conventional engine valve actuation systems are not able to meet these demands.

SUMMARY OF THE INVENTION

Briefly stated, in one aspect of the invention, one preferred embodiment of an actuator includes a driver further including a housing defining a longitudinal axis and first and second directions, an actuation mechanism capable of generating actuation force at least in the first direction, and a rod with one end operably connected with at least one part of the actuation mechanism and with the other end available for an operable connection with a load such as an engine valve; at least one return spring operably connected with the rod through a spring retainer assembly and biasing the rod in the second direction; and a pneumatic booster further including a pneumatic cylinder, a pneumatic piston operably connected with the rod through the spring retainer assembly and biasing the rod in the first direction, a charge mechanism providing a controlled fluid communication between the pneumatic cylinder and a high-pressure gas source, and a bleed mechanism providing a controlled fluid communication between the pneumatic cylinder and a low-pressure gas sink.

In operation, the actuator holds the load to a second-direction end position with the force from the at-least-one return spring biasing in the second direction and overcoming the sum of the rest of the forces including those from the pneumatic booster and the load, without generating the actuation force in the first direction from the actuation mechanism, and with the pneumatic booster being charged through the charge mechanism to yield a substantial force in the first direction to oppose a substantial load force in the second direction.

The actuator initiates the travel of the load in the first direction by generating the actuation force in the first direction from the actuation mechanism, with the combination of the actuation force and the force from the pneumatic booster being able to overcome the sum of the rest of the forces including those from the at-least-one return spring and the load and accelerate the load in the first direction.

The actuator keeps the travel in the first direction with the actuation force in the first direction until reaching the target stroke, and keeping the actuation force in the first direction if the load needs to be held at the target stroke. The actuator initiates the return travel of the load in the second direction at least by turning off the actuation force in the first direction so that the load is accelerated in the second direction at least by the return spring.

The actuator bleeds off excess air in the booster cylinder through the bleed mechanism during at least part of the time period described in the above paragraph to reduce the force from the pneumatic booster, which is otherwise too excessively resistant to the return travel of the load. It completes the return travel with a decreasing force from the return spring and an increasing force from the pneumatic booster, which help slow down the load.

In another embodiment, the driver is a fluid driver, the actuation mechanism comprising an actuation piston, an actuation cylinder, first and second fluid spaces in fluid communication with first and second ports, respectively; and the rod being a piston rod operably connected with the actuation piston and the load.

In another embodiment, the driver is an electromagnetic driver; the actuation mechanism comprising an armature disposed in an armature chamber, and at least a first electromagnet on the first direction side of the armature chamber, whereby being able to pull the armature in the first direction when energized; and the rod being an armature rod operably connected with the armature and the load.

In another embodiment, the charge mechanism includes a charge orifice, whereby substantially restricting the charge flow rate. It may also includes a control mechanism that substantially closes off charge flow at least when the bleed mechanism is actively bleeding off excess air.

The present invention provides significant advantages over the prevailing fluid actuators and their control, especially those needed for the cross-over passage engine valve that needs a large initial opening force, a substantial seating force, a reasonably low seating velocity, a high actuation speed, and timing flexibility while consuming minimum energy by itself. The pneumatic booster is able to provide that large initial force, without adding too much construction complexity or demanding too much energy consumption or stretching the capacity and functional limits of the fluid or electromagnetic actuators, by tapping directly into the cross-over passage or the air storage tank. With the charge mechanism, the boost force can be directly adjusted to the varying operating pressure in the cross-over passage, without sophisticated active control. With the bleed mechanism, the engine valve return force can be greatly reduced by making the boost force to be substantially lower during the return stroke.

With the pneumatic booster, the driver, be it a fluid or electromagnetic one, is able to concentrate on more or less conventional valve actuation, without the design, function and cost burden associated with the large initial opening force, which conventionally entails large flow rate and package size for fluid drivers and high, if not impossible, magnetic force and electrical power for electromagnetic drivers.

The present invention, together with further objects and advantages, will be best understood by reference to the following detailed description taken in conjunction with the accompanying drawings.

DETAILED DESCRIPTION OF THE INVENTION

Figure 1:
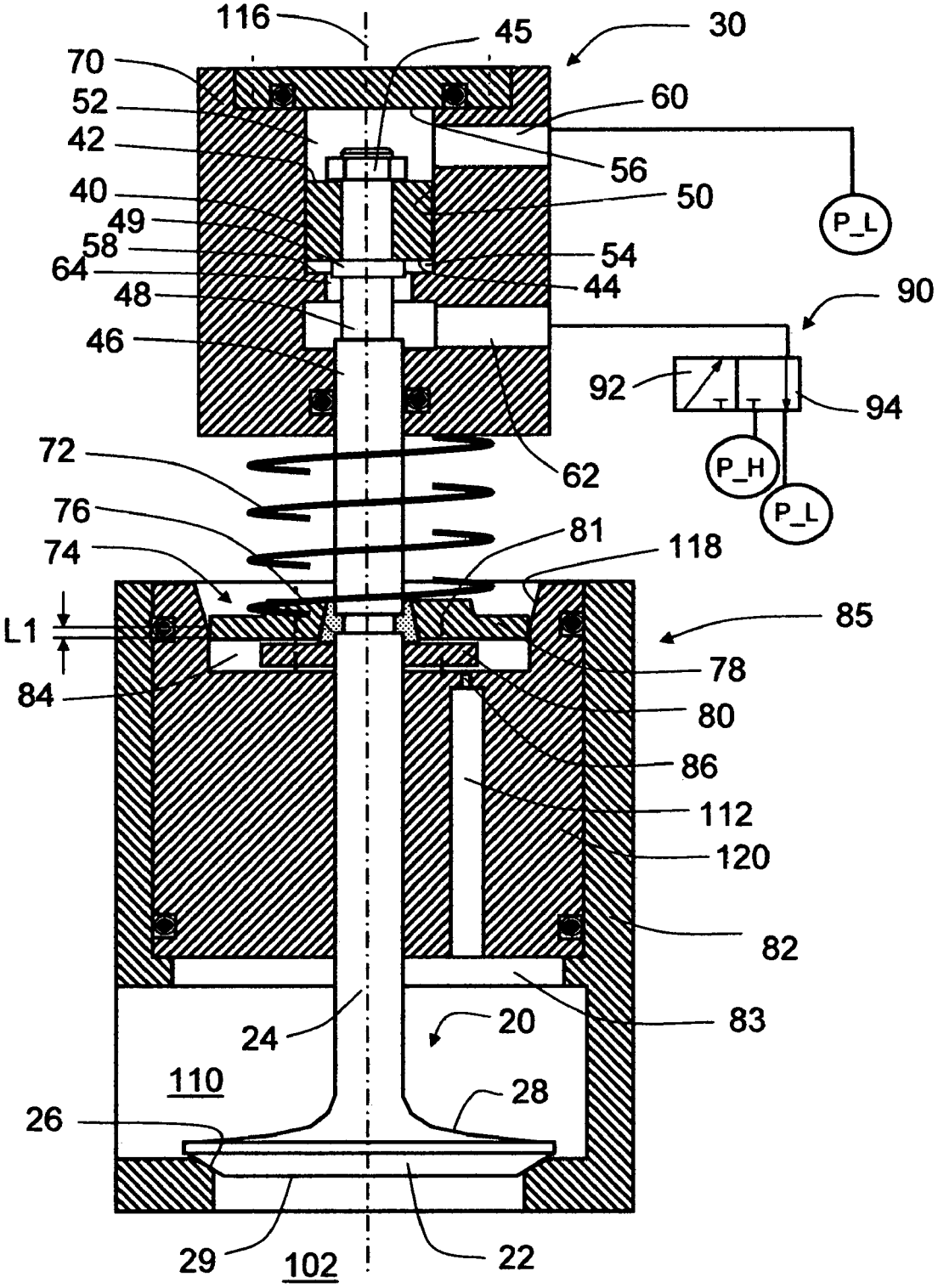
FIG. 1 is a schematic illustration of one preferred embodiment of the engine valve actuator, which is at a closed state.

Referring now to FIG. 1, a preferred embodiment of the invention provides an actuator including a fluid driver 30, an actuation 3-way valve 90, an return spring 72, and a pneumatic booster 85. The load or control target of the actuator is an engine valve 20.

The actuation 3-way valve 90 supplies the fluid driver 30 through a second port 62 of the fluid driver 30. The 3-way valve 90 has two of its three ways connected with a low-pressure P_L fluid line and a high-pressure P_H fluid line, and the third way connected with the second port 62. A first port 60 of the fluid driver 30 is in fluid communication directly with the low-pressure P_L fluid line.

The actuation 3-way valve 90 is switched either to a left position 92 or a right position 94. At the left and right positions 92 and 94, the second port 62 is in fluid communication with the P_H and P_L lines, respectively.

The pressure P_H can be either constant or continuously variable. When variable, it is to accommodate variability in system friction, engine valve opening, air pressure, the engine valve seating velocity requirement, etc., and/or to save operating energy when possible. The pressure P_L can be simply the fluid tank pressure, the atmosphere pressure, or a fluid system backup pressure. The fluid system backup pressure can be simply supported or controlled, for example, by a spring-loaded check valve, with or without an accumulator. The P_L value is preferred to be as low as possible to increase the system efficiency, and yet high enough to help prevent fluid cavitation. When necessary, The P_L can be more tightly controlled as well. When necessary and/or allowed, the two P_L lines connected with the two ports 60 and 62 may maintain two pressure values. For example, the first port 60 may be simply used to dump some leakage flow to the fluid tank (not shown in FIG. 1). In this case, much of the first fluid space may be simply filled with air, instead of the working fluid (assuming the working fluid is not air).

The engine valve 20 includes an engine valve head 22 and an engine valve stem 24. The engine-valve head 22 includes a first surface 28 and a second surface 29, which in the case of a split-cycle engine, are exposed to a cross-over passage 110 and the engine cylinder 102, respectively. The engine valve 20 is operably connected with the fluid driver 30 along a longitudinal axis 116 through the engine valve stem 24, which is slideably disposed in an engine valve guide 120. For ease of description, the assembly and the longitudinal axis 116 have first and second directions, which are the same as the top and bottom directions, respectively, in FIG. 1. The engine valve guide 120 as illustrated in FIG. 1 does not look like a traditional engine valve guide, which normally is a sleeve with a much limited wall thickness. The guide 120 is designed to be situated in the cylinder head 82, over a valve assembly opening 83, which is large enough to slide through the engine valve head 22 during assembly. This is just one of many potential assembly options. This does not exclude the possibility of adding a traditional-looking sleeve inside the guide 120. The guide 120 may contain necessary engine coolant and lubricant passages (not shown in FIG. 1).

When the engine valve 20 is fully closed, the engine valve head 22 is in contact with an engine valve seat 26, sealing off the fluid communication between the cross-over passage 110 and the engine cylinder 102.

The fluid driver 30 comprises an actuator housing 70, an actuation piston 40, and an actuation cylinder 50. The actuation piston 40 is slideably disposed in the actuation cylinder 50. The actuation piston 40 is fixed on to a piston rod 46 between a fastening element 45 and a shoulder 49. The actuation piston 40 includes a first surface 42 and a second surface 44, and longitudinally divides the actuation cylinder 50 into a first fluid space 52 (between an actuation-cylinder first end 56 and an actuation-piston first surface 42) and a second fluid space 54 (between the actuation-piston second surface 44 and the actuation-cylinder second end 58). The radial clearances around the actuation piston 40 and the piston rod 46 are substantially tight, provide substantial fluid seal, and yet offer tolerable resistance to relative motions.

The second fluid space 54 is in fluid communication with the second port 62 through a second flow passage 64 around a neck feature 48 on the piston rod. The second flow passage 64 becomes substantially more restrictive when the actuation piston 40 is close to the actuation-cylinder second end 58, with the shoulder 49 longitudinally approaching and/or overlapping the second flow passage 64. If a second flow mechanism is defined to include the second flow passage 64, the neck 48, and the shoulder 49, then the second flow mechanism provides substantially open fluid communication between the second; fluid space and the second port. It provides a snubbing function when the actuation piston 40 is close to the actuation-cylinder second end 58. When desired, the second flow mechanism may also include a one-way or check valve (not shown in FIG. 1), providing a parallel, substantially-open fluid communication from the second port 62 to the second fluid space 54.

The first fluid space 52 is in fluid communication with the first port 60 without much flow restriction.

The piston rod 46 is operably connected with the engine valve stem 24, and in this embodiment (as illustrated in FIG. 1) the rod 46 and stem 24 are structurally the same part, which is not the only design option.

A spring retainer assembly 74 is designed to help hold the return spring 72 and transfer its force on to the engine valve stem 24. The return spring 72 as illustrated in FIG. 1 is a single mechanical compression spring. This does not exclude other design options, such as a pair of compression springs in parallel. The spring 72 may also be in the form of the Belleville type or pneumatic nature.

The spring retainer assembly 74 includes a first and second spring retainers 78 and 80 and a set of valve keepers 76. The first spring retainer 78 also functions or doubles as a pneumatic piston, which is slideably disposed inside a pneumatic cylinder 84, a cavity at the top of the engine valve guide 120, to form the pneumatic booster 85. The side, sliding walls of the first spring retainer 78 and the pneumatic cylinder 84 maintain an air-tight seal and yet reasonable level of friction with necessary lubrication and sealing mechanism (details not in FIG. 1). The return spring 72 and the pneumatic booster 85 apply forces to the first retainer 78, and thus the engine valve stem 24, in the second and first directions, respectively. The spring retainer assembly 74 is thus designed to sustain forces in both directions. The force from the return spring 72 is applied to the first spring retainer 78, and is transferred, through the valve keepers 76, to the engine valve stem 24. The pneumatic force from the pneumatic cylinder 84 is primarily applied to the first spring retainer 78, and is transferred to the valve stem 24 through spring-retainer fastening means 81 (details of which are not illustrated in FIG. 1), the second spring retainer 80, and the valve keepers 76.

The pneumatic cylinder 84 is charged or supplied with the pressurized gas or air from the cross-over passage 110, a high-pressure gas source, through a charge mechanism including a charge passage 112 and a charge orifice 86. The charge orifice 86 is designed to be more restrictive than the charge passage 112. The passage 112 and orifice 86 may be combined into a single restrictive long orifice (not shown in FIG. 1). The separate construction or existence of the charge orifice 86 may ease the manufacturing process. The pneumatic cylinder 84 is also intentionally designed to have an expansion 118 in its top portion so that a substantially air-tight seal between the first retainer 78 and the pneumatic cylinder 84 is kept only when the engine valve 20 is seated and within a predefined distance L1 of the engine valve travel in the first direction, beyond which there is a substantial clearance or bleed passage between the pneumatic cylinder 84 and the first retainer 78, and the pneumatic cylinder 84 is in substantial fluid communication with the atmosphere or a lower-pressure gas sink and yet is in a restrictive fluid communication with the cross-over passage 110.

The actuation cylinder 50 offers substantial room longitudinally such that the actuation piston 40 does not touch the first and second ends 56 and 58 of the cylinder 50 when the load or engine valve 20 is at its first-direction and second-direction end positions, respectively. When the engine valve 20 is seated or at its second-direction end position as shown in FIG. 1, there is still a distance between the actuation-piston second surface 44 and the actuation-cylinder second end 58 to accommodate the engine valve lash adjustment. When the engine valve 20 is fully open or at its first-direction end position, there is enough force from the return spring 72 and/or enough longitudinal space in the cylinder 50 to prevent a direct contact between the actuation-piston first surface 42 and the actuation-cylinder first end 56.

Alternatively, one may design for the engine valve opening travel to be limited or defined by the physical contact between the actuation-piston first surface 42 and the actuation cylinder first end 56, or between their equivalent surfaces, with necessary snubbing or control measures, like those shown later in FIGS. 2 and 5.

The engine valve head 22 is generally exposed to the pressure of the cross-over passage 110 on the first surface 28 and the pressure of the engine cylinder 102 on the second surface 29.

The cross-section area of the first spring retainer or the pneumatic: piston 78 is to be substantially equal to that of the engine-valve head so that the pneumatic pressure force on the pneumatic piston 78 substantially cancels the pressure force on the engine-valve first surface 28 when the pressure in the pneumatic cylinder 84 is substantially equal to that in the cross-over passage, due to fluid communication through the charge orifice 86. Alternatively, the cross-section area of the pneumatic piston 78 is to be appreciably, but not necessarily substantially, different from, either larger or smaller than, that of the engine valve head 22. A larger pneumatic piston cross-section area, for example, offers an extra engine valve opening force so that a relatively more compact fluid driver 30 is sufficient.

The system also experiences various friction forces, steady-state flow forces, transient flow forces, and other inertia forces. Steady-state flow forces are caused by the hydrostatic pressure redistribution due to flow-induced velocity variation, i.e. the Bernoulli effect. Transient flow forces are fluid inertial forces. Other inertial forces result from the acceleration of objects, excluding fluid here, with inertia, and they are substantial in an engine valve assembly because of the large magnitude of the acceleration or the fast timing.

Power-Off State

At power-off state, all fluid supply sources P_H and P_L are at low or zero gage pressure. The total fluid force on the actuation piston 40 is substantially equal to zero. The engine valve can be seated or closed by the return spring 72 alone. The seating is even more secure if the pneumatic piston 78 has a smaller diameter than the engine valve head 22, and the cross-over passage 110 is still sufficiently pressurized, especially for an air-hybrid application with an air storage tank.

At the power-off, the default position of the actuation 3-way valve 90 is preferably, but not necessarily, to be in its right position 94 as shown in FIG. 1 so that the second fluid space 54 is in fluid communication with the low pressure P_L fluid line and is surely at a low or zero gage pressure if a secure engine valve seating is important or critical. Immediately after engine off, the high pressure P_H fluid line may be still pressurized. At the engine start, the engine valve 20 can be kept at the closed position without actively switching the valve 90.

Start-Up

To start-up the system from the power-off state, all fluid supply sources are pressurized, and the actuation 3-way valve 90 is secured, either by default or active control, at its right position 94 as shown in FIG. 1. The engine valve 20 is secured, at least by the return spring 72, at the closed or seated position as shown in FIG. 1.

Valve Opening and Closing

To open the engine valve 20, the actuation 3-way valve 90 is switched to its left position 92. The second fluid space 54 is open to the high pressure P_H supply through the second flow mechanism, while the first fluid space 52 remains to be exposed to the low pressure P_L supply. The resulting differential pressure force on the actuation piston 40 is in the first direction (or upward in FIG. 1) to overcome primarily the spring force, driving open the engine valve 20. At the same time, the downward differential air pressure force on the engine valve 20 is substantially balanced by the upward differential air pressure force on the pneumatic piston 78, considering that the pneumatic cylinder 84 is under the same pressure as the cross-over passage 110. In a split-cycle engine, the dominant force on an engine valve is the air pressure force from the cross-over passage 110. The incorporation of the pneumatic piston 78 helps balance out and counter this large force, which otherwise demands an extremely large and energy-intensive actuator.

As soon as the engine valve 20 cracks open, the engine cylinder 102 is filled rapidly, and its pressure reaches the cross-over passage pressure within a short period of time, well before the engine valve 20 passes the middle point of the opening stroke, resulting in a rapid disappearance of the differential pressure on the engine valve surfaces 28 and 29. During the same short period of time, the pressure in the pneumatic cylinder 84 and the differential pressure on the pneumatic piston 78 drop rapidly as well because of its limited, predefined initial volume, its rapid volume expansion associated with the engine valve movement, a limited amount of air inflow through the charge orifice 86, and the bleeding off of the air as the pneumatic piston 78 moves up a predefined distance L1, as shown in FIG. 1, to the expanded top portion 118 of the pneumatic cylinder 84.

For the rest of the opening stroke or beyond the distance L1, the air pressure forces on the pneumatic piston 78 and the engine valve 20 are minimum, and the actuation piston 40 continues to drive the engine valve 20 in the first direction (or upward in FIG. 1) against an increasing spring force from the return spring 72 until the engine valve reaches its full open position, when the spring force and the fluid differential force across the actuation piston 40 are balanced, which is expected to be dynamic with certain overshoot and damped oscillation, considering the spring-mass nature of the construction. There are however measures, as shown in other preferred embodiments (FIGS. 2 and 4), to have a more definitive lift or full open position.

The engine valve 20 remains open as long as the actuation 3-way valve 90 remains at its left position 92. During this period, the pneumatic cylinder 84 keeps receiving a small stream of air flow from the charge orifice 86 and keeps bleeding the air out through the substantial gap between the pneumatic piston 78 and its top, expanded cylinder wall 118. This energy loss will continue until the pneumatic piston 78 is back at the lower portion of the pneumatic cylinder 84. However, the energy loss is minimized by the restrictive nature of the charge orifice 86 and the limited engine valve opening period relative to the entire thermal cycle.

To start closing the engine valve, the actuation 3-way valve 90 is switched to its right position 94, and the second fluid space 54 is open back to the low pressure P_L fluid supply, resulting in a substantially zero pressure differential across the actuation piston 40. The return spring 72 is able to drive the engine valve 20 downward. When the pneumatic piston 78 passes the expanded part 118 of the pneumatic cylinder 84, a substantially air-tight seal is established again between the pneumatic piston 78 and the wall of the pneumatic cylinder 84, and the pressure in the pneumatic cylinder starts building up primarily because of a shrinking cylinder volume as the engine valve 20 and thus the pneumatic piston 78 move downward. The pressure build-up is also assisted by the flow from the charge orifice 86. The pneumatic cylinder 84 functions like a pneumatic spring, slowing down the advancement of the engine valve 20 and eventually helping achieve a soft-seating when the engine valve 20 reaches the engine-valve seat 26.

Around the engine valve seating or landing and shortly after that, the pressure in the engine cylinder momentarily exceeds the cross-over passage pressure because of the effect of the combustion, resulting in a transient differential pressure force in the first direction or upward. The preload of the return spring 72 should be designed to be able to hold the engine valve 20 in seated position against this transient upward differential force on the engine valve and also against the pressure force from the pneumatic cylinder 84. The pneumatic cylinder pressure, at this moment, is however not equal to the full cross-over pressure. It is purposely so by earlier bleeding off through the expanded portion 118 of the pneumatic cylinder 84 and the restrictive nature of the charge orifice 86.

Thereafter, the engine cylinder pressure drops below the cross-over passage pressure as the volume expands further. The pneumatic cylinder pressure rises up further through the restricted flow from the charge orifice 86 during the rest of the engine thermal cycle, which is slow but sure enough to be ready for the next engine valve opening event.

Figure 2:
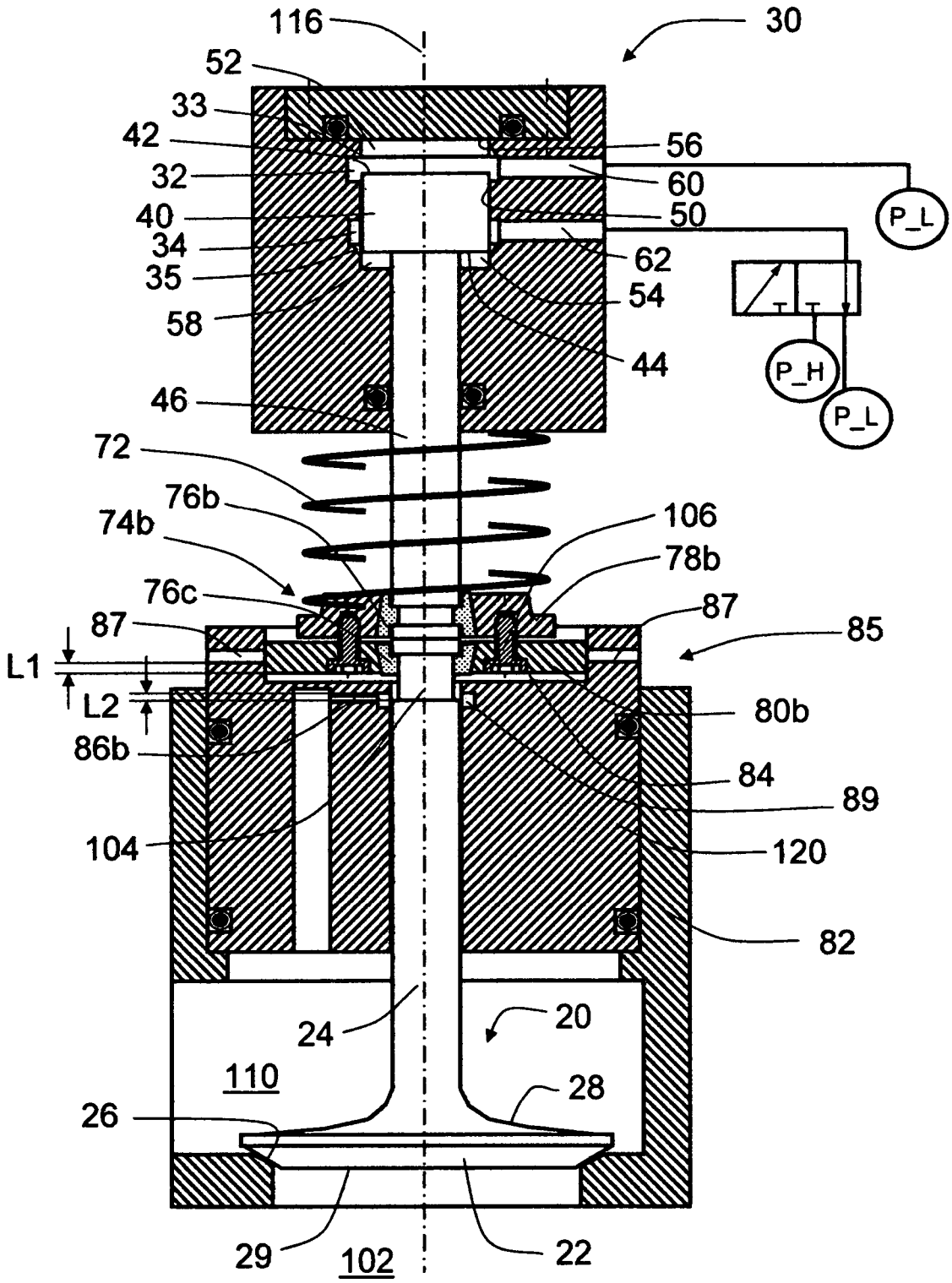
FIG. 2 is a schematic illustration of another preferred embodiment, which includes design variations in the fluid driver, the spring retainer assembly, and the pneumatic booster.

FIG. 2 depicts an alternative embodiment of the invention that features some variations in the design of the fluid driver 30. The first flow mechanism, which is the means of the fluid communication between the first port 60 and the first fluid space 52, includes a first undercut 32 and at least one first snubbing groove 33. When the actuation-piston first surface 42 passes the first undercut 32 longitudinally in the first direction during an opening stroke, the working fluid is substantially trapped in the first fluid space 52, with only a limited outlet through the at-least-one first snubbing groove 33, resulting in a snubbing action to help slow down the travel speed and reduce potential oscillation. When so desired, the actuation-cylinder first end can be longitudinally arranged to provide a solid stop to the actuation-piston first surface 42, thus a well defined engine valve lift. If so desired, a check valve (not shown in FIG. 2) can be arranged to allow one-way flow from the first port 60 into the end of the first fluid space 52 during the starting phase of the engine valve closing stroke to avoid cavitation.

Similarly, the second flow mechanism, which is the means of fluid communication between the second port 62 and the second fluid space 58, includes a second undercut 34 and at least one second snubbing groove 35. When the actuation-piston second surface 44 passes the second undercut 34 longitudinally in the second direction during an closing stroke, the working fluid is substantially trapped in the second fluid space 58, with only a limited outlet through the at-least-one second snubbing groove 35, resulting in a snubbing action to help slow down the travel speed and achieve soft-seating for the engine valve 20. It is desired to leave a predefined longitudinal distance between the actuation-cylinder second end and the actuation-piston second surface 44 to ensure a solid contact and tight seal between the engine valve head 22 and the valve seat 26 when the engine valve 20 is seated, which has to be accommodated at all engine operating conditions and throughout the engine's service life. When necessary, additional engine valve lash adjustment device (not shown in FIG. 2) is to be integrated in this and other embodiments.

The embodiment in FIG. 2 further features variations in the design of the spring retainer assembly 74. The second spring retainer 80, instead of the first spring retainer 78, functions or doubles as the pneumatic piston 80. It also includes two sets of valve keepers 76*b* and 76*c*. This embodiment allows the engine valve stem 24 and the piston rod 46 to be physically two separate pieces, united operably by the spring retainer assembly 74 with necessary fastening means 106 or the equivalent.

This embodiment also shows variations in the charging and bleeding mechanisms for the pneumatic booster 85. It adopts at least one bleed hole 87 as the bleed passage, instead of an expanded wall 118 in FIG. 1, for the pneumatic cylinder 84 to discharge its extra gas when the pneumatic piston 80*b* travels up a predefined distance L1 as shown in FIG. 2. The bleed holes 87 may be fitted with porous materials or filters (not shown) to reduce noise associated the bleeding process. To save the effort and cost of drilling or casting the bleed holes 87, one may also simply design the engine valve guide 120, and thus the pneumatic cylinder 84, up to that height, causing the pneumatic piston 80*b* to be disengaged from the pneumatic cylinder 84 once it travels up to that point, resulting in a wide open bleeding process.

One can also use some predefined variation (not shown in FIG. 2) in the radial clearance between the pneumatic piston 80*b* and the pneumatic cylinder 84. Adopting an opposite approach, some diaphragm (not shown in FIG. 2) may be used to completely seal off leakage through the radial clearance, totally depending on the at-least-one bleed hole 87 or its equivalent for the control of the air or gas mass discharge. Also, when desired, one may use a control valve (not shown in FIG. 2) to control its on/off state.

The charge orifice 86*b* in FIG. 2 is regulated by a control mechanism including an orifice gate 89 and a stem undercut 104, which are not open to each other when the engine valve 20 travels up a predefined distance L2 (as shown in FIG. 2). The distance L2 is preferably to be equal or shorter than the distance L1 so that the flow through the charge orifice 86*b* and thus the charging process are substantially blocked when the discharging process, through the bleed hole 87 or its equivalent, is active. This variation in the charge mechanism will help reduce unnecessary, however small, energy loss.

Figure 3:
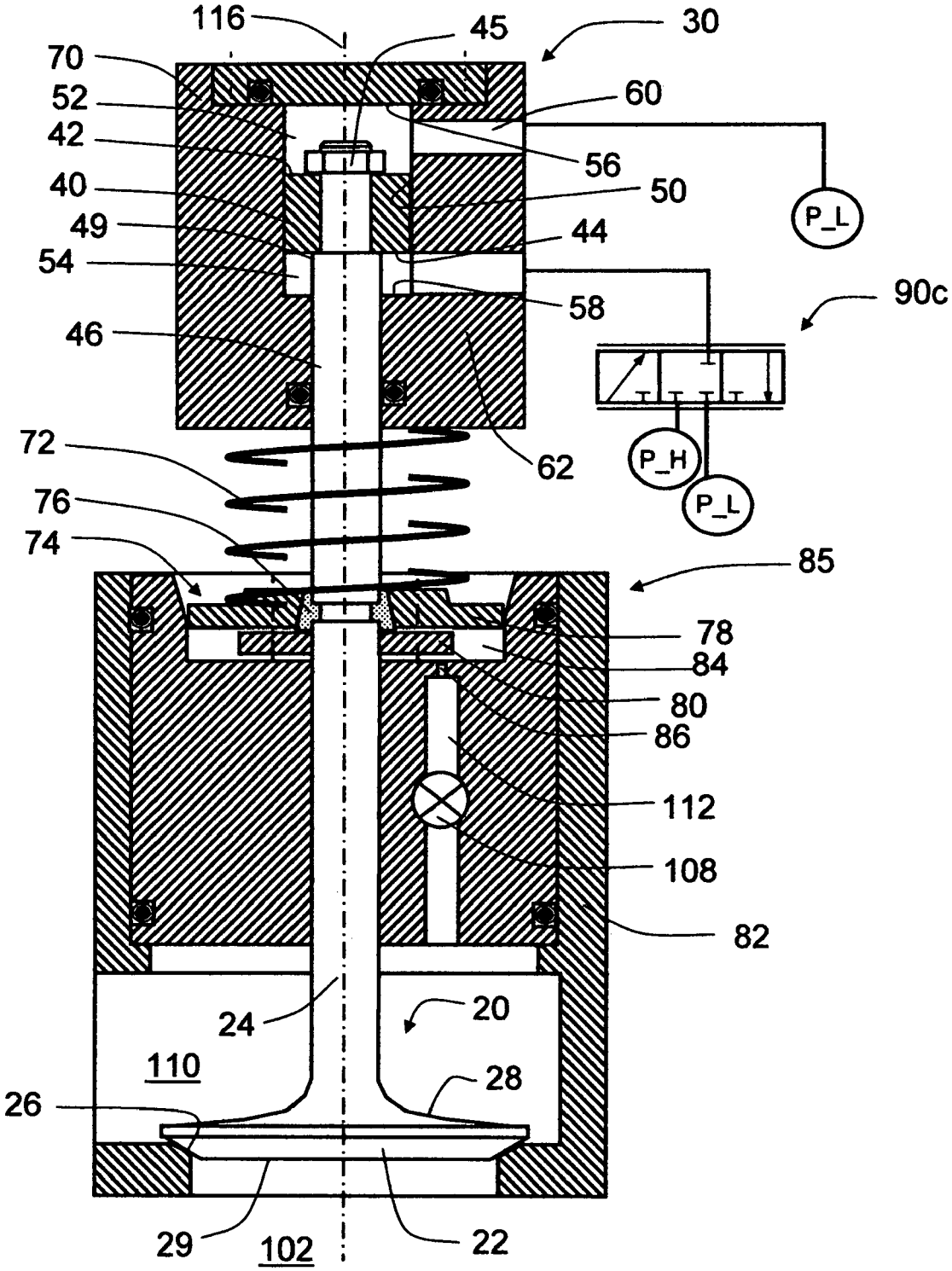
FIG. 3 is a schematic illustration of another preferred embodiment, which includes a 3-way proportional valve and a charge valve.

Refer now to FIG. 3, which is a drawing of yet another alternative embodiment of the invention. In this fluid driver 30, a proportional or servo 3-way valve 90*c* is used to control the fluid supply to the second fluid space 54. The engine valve or actuator position signal can be collected via a position sensor (not shown in FIG. 3). The feedback control will help achieve more precise control over the engine valve lift and seating velocity. The proportional or servo valve 90*c* itself can be actuated directly via various means (not shown in FIG. 3), including solenoids or other electromagnetic means, electro-hydraulic pilot valves, and piezoelectric actuators.

This embodiment further features a charge valve 108, as a control mechanism, along the charge passage 112 to help achieve better control over the charging process for the pneumatic cylinder 84. The charge valve 108 has at least one of two major functions: (1) to open the charge passage 112, allowing the pneumatic cylinder 84 to be charged, before the engine valve opening stroke, and close the charge passage 112 especially if the restrictive charge orifice 86 is not used, eliminating or reducing leak flow when the pneumatic cylinder 84 is being bled; (2) to completely close off the charge passage 112 when the engine or that particular engine cylinder is power-off, as in an air hybrid vehicle, minimizing leakage and preserving the pressurized air in the cross-over passage and/or the air storage tank. For the first function, one charge valve 108 is needed for each power cylinder of the split four-stroke cycle engine because each power cylinder has its unique timing. If only the second function is needed, one may optionally use only one charge valve 108 for an entire engine, with the valve 108 controlling a common charge passage (not shown in FIG. 3) that eventually branches into tributary charge passages (not shown in FIG. 3) for individual power cylinders (not shown in FIG. 3). Further for the first function, the charge valve 108 may be optionally a proportional valve, instead of an on/off valve. By being a proportional valve, the charge valve 108 is able to actively control, for example, the air pressure in the pneumatic cylinder 84 for various functional, durability and NVH needs.

At this and other figures, the charge passage 112 is connected to the cross-over passage 110. Optionally, it can be connected to the air storage tank (in the case of an air hybrid vehicle) or a separate reservoir (not shown in the figures). The separate reservoir may have its own pressure, which may be regulated to help achieve optimum charging process for the pneumatic cylinder 84.

Figure 4:
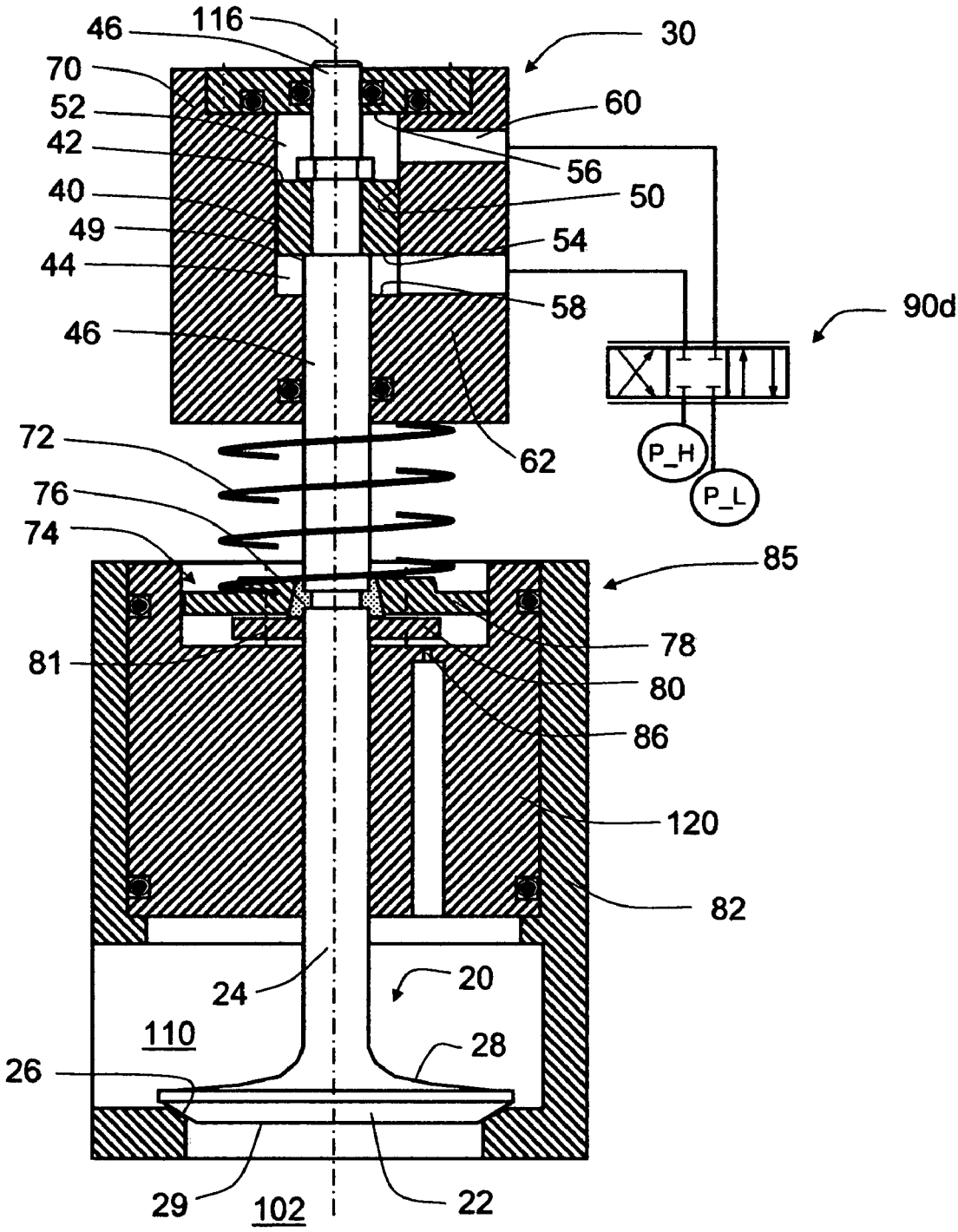
FIG. 4 is a schematic illustration of another preferred embodiment, which includes a 4-way proportional valve, a fluid driver with a double-ended piston rod, and a pneumatic booster without a bleed mechanism.

Refer now to FIG. 4, which is a drawing of yet another alternative embodiment of the invention. In this case, a proportional or servo 4-way valve 90*d* is used to control the fluid supply both to the first and second fluid spaces 52 and 54. This embodiment is able to provide actively-controlled actuation forces both in the first and second directions. Optionally, the piston rod 46 extends longitudinally through the first fluid space 52, becoming a double-ended piston rod. To have a biased or asymmetric differential fluid force, the two ends of the piston rod may possess two different diameters, with the side with a smaller rod diameter having a larger effective fluid pressure surface area.

Still another variation or option is its lack of a bleed mechanism. The actuation force in the second direction will easily help overcome the high air pressure force from the pneumatic booster 85 during the engine valve closing. The elimination of the bleed mechanism will help simplify the construction of the pneumatic booster 85. Without a bleed mechanism or substantial leakage, the charge mechanism, including the charge orifice 86, is still needed to compensate for potential minor leakages, and adjust the pressure and air mass level in the pneumatic booster 85 to accommodate the pressure level variation in the cross-over passage or air storage tank. The actuator needs a lower boost force, for example, when the cross-over passage pressure is lower. In this sense, the charge mechanism also has a balance function, which is even true for the pneumatic boosters with a bleed mechanism.

Depending on the application, the rest of the embodiment in FIG. 4 may still be integrated with one of the bleed mechanisms featured in earlier embodiments (illustrated in FIGS. 1-3) if a lower air pressure force is ideal for the engine valve seating process.

Figure 5:
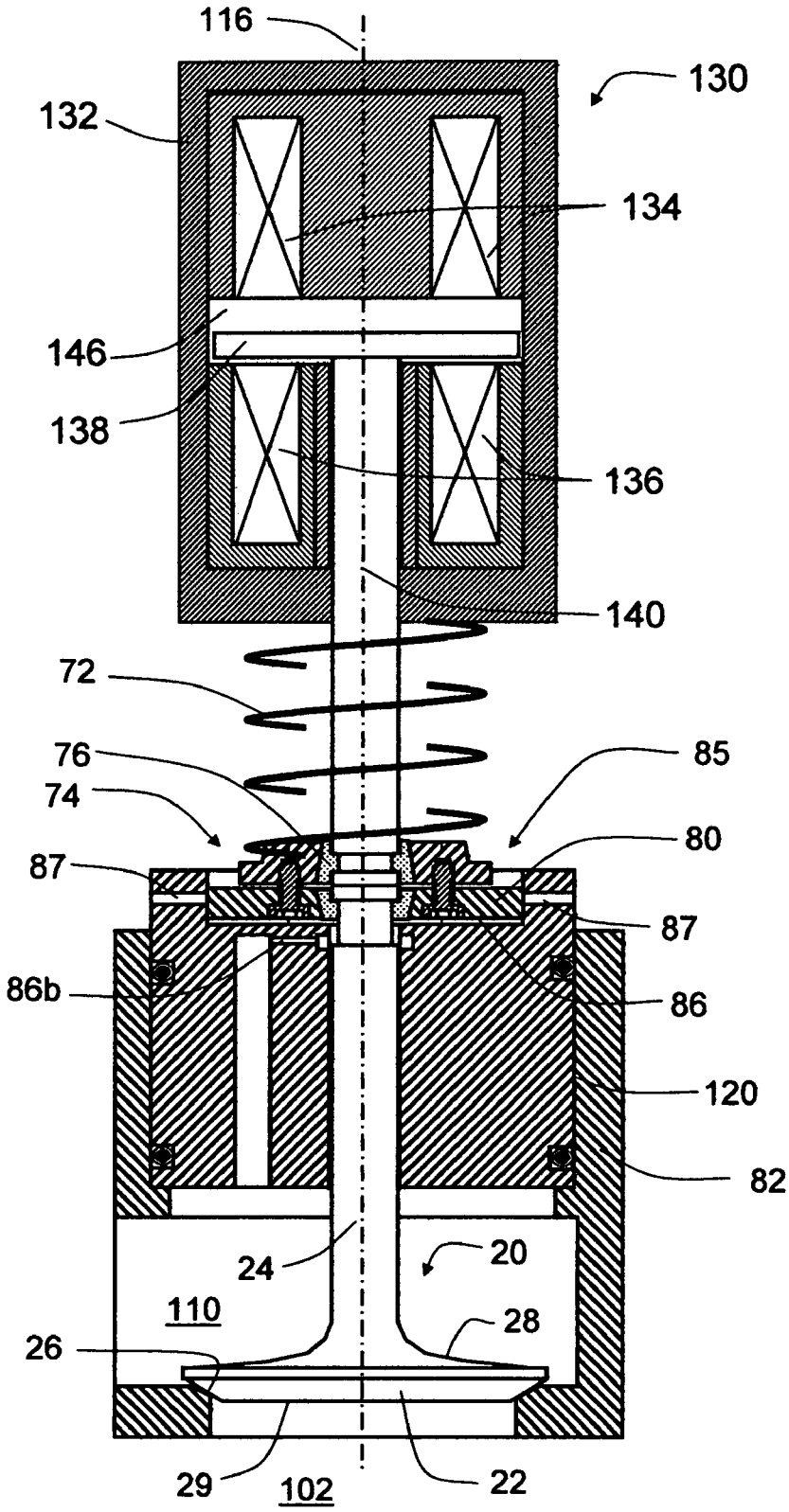
FIG. 5 is a schematic illustration of another preferred embodiment, which includes an electromagnetic driver.

Refer now to FIG. 5, which is a drawing of yet another alternative embodiment of the invention. In this embodiment, an electromagnetic driver 130 replaces the fluid drivers 30 in FIGS. 1-4. The electromagnetic driver 130 includes a housing 132, within which from the top to the bottom are a first electromagnet 134, an armature chamber 146, and a second electromagnet 136. The first and second electromagnets 134 and 136 further include their electrical windings and lamination stacks, details of which are not shown in FIG. 5. An armature 138 is disposed inside the armature chamber 146 and between the first and second electromagnets 134 and 136 and is rigidly connected to an armature rod 140. The armature rod 140 is slideably disposed through the second electromagnet 136 and the housing 132, and is operably connected with the engine valve stem 24.

When powered, the first and second electromagnets 134 and 136 attract the armature 138 in the first (top) and second (bottom) directions, respectively. The first electromagnet 134 is able to catch the armature 138 and keep the engine valve 20 open at the full lift. To crack open the engine valve 20 when the air pressure forces on the engine valve 20 and the pneumatic piston 80 are substantially balanced, the first electromagnet 134 only needs to overcome the preload from the return spring 72, which is achievable despite the highly nonlinear nature of the electromagnetic force because the overall lift for the cross-over engine valve and thus the air gap between the armature 138 and the electromagnet 134 are small. This can be further assisted, if necessary, by designing the pneumatic piston 80 to be appreciably larger than the engine valve head 22 and thus introducing a differential air pressure force in the first direction.

To close the engine valve 20 from the full open position, the first electromagnet 134 is de-energized, and the engine valve 20 is pushed down by the returning force of the return spring 72, with the pulling assistance, if necessary, from an energized second electromagnet 136. During the later phase of the closing, the pneumatic cylinder 86 is pressurized by volumetric contraction and optional charging action through the charge orifice 86*b*, and it helps slow down the engine valve 20 to achieve soft-seating. A further retarding action can be achieved by re-energizing the first electromagnet 134 in a controlled way, resulting in a desired pulling force in the first direction depending on the operational needs or feedback signal.

The pulling force in the second direction from the second electromagnet 136 may also assist the return spring 72, if a low spring preload is desired otherwise, in keeping the engine valve 20 seated during at least part of combustion, when the pressure in the power cylinder 102 appreciably exceeds that in the cross-over passage 110.

If the pneumatic booster 85 includes a bleed mechanism like the bleed holes 87 in FIG. 5, the second electromagnet 136 is an optional component, which can be eliminated if the return spring 72 and other related components are sufficient for various functions.

The second electromagnet 136 is indispensable, however, if one is to adopt a pneumatic booster design without, as shown in FIG. 4, a bleed mechanism. In this case, the second electromagnet 136 needs to generate an actuation force in the second direction to help overcome a high air pressure force from the pneumatic booster during the engine valve closing, when there is no high differential air pressure force on the engine valve to balance the force from the pneumatic booster.

In FIGS. 1-5, various embodiments of the pneumatic booster 85 are specially developed to overcome the initial pressure force on the engine-valve first surface 28 to crack open the engine valve. Yet, through its bleed mechanism, the pneumatic booster 85 is able to scale down its pressure force for the valve closing when the differential pressure force across the engine valve head is substantially smaller. With this pneumatic booster 85, the fluid drivers 30 in FIGS. 1-4 and the electromagnetic driver 130 in FIG. 5 are able to handle the less forceful part of the engine valve opening and closing. The effective integration of the various embodiments of the pneumatic booster 85 is not limited to those fluid and electromagnetic drivers 30 and 130 discussed above. In fact, any driver with sufficient force and control for the engine valve acceleration, deceleration, and seating control will do, with the large initial opening force being taken care of by the pneumatic booster 85.

In all the above descriptions, each of the switch and/or control valves may be either a single-stage type or a multiple-stage type. Each valve can be either a linear type (such as a spool valve) or a rotary type. Each valve can be driven or piloted by an electric, electromagnetic, mechanic, piezoelectric, or fluid means.

In some illustrations and descriptions, the fluid medium may be assumed or implied to be in hydraulic or in liquid form. In most cases, the same concepts can be applied, with proper scaling, to pneumatic boosters and systems. As such, the term "fluid" as used herein is meant to include both liquids and gases. Also, in many illustrations and descriptions so far, the application of the invention is defaulted to be in split four-stroke cycle internal combustion engine valve control, and it is not limited so. The invention can be applied to other situations where a fast and/or high-initial-force control of the motion is needed.

Although the present invention has been described with reference to the preferred embodiments, those skilled in the art will recognize that changes may be made in form and detail without departing from the spirit and scope of the invention. As such, it is intended that the foregoing detailed description be regarded as illustrative rather than limiting and that it is the appended claims, including all equivalents thereof, which are intended to define the scope of this invention.

I claim:

1. An actuator, comprising a fluid driver including a housing defining a longitudinal axis and first and second directions, an actuation mechanism comprising an actuation cylinder and an actuation piston slideably disposed in the actuation cylinder, with the actuation mechanism generating actuation force at least in the first direction;

at least one return spring operably connected with the actuation mechanism and biasing the actuation mechanism in the second direction; and a pneumatic booster operably connected with the actuation mechanism and biasing the actuation mechanism in the first direction, whereby giving the driver a boost force in the first direction; and wherein:

the pneumatic booster further including a pneumatic cylinder; a pneumatic piston, slideably disposed in the pneumatic cylinder for at least part of its travel range; and a charge mechanism, whereby charging the pneumatic cylinder and balancing its pressure with pressurized air from a high-pressure gas source during at least part of an actuation cycle of the actuator;

the charge mechanism including a control mechanism, whereby substantially closing off the charge flow during a substantial portion of a period when the pneumatic cylinder is not at its minimum volume;

the actuation mechanism being operably connected with a load of the actuator through a stem;

the control mechanism of the charge mechanism including an orifice gate and an undercut on the stem; and the charge flow being open and closed when the orifice gate and the undercut longitudinally overlap and underlap respectively.

2. An actuator, comprising a fluid driver including a housing defining a longitudinal axis and first and second directions, an actuation mechanism comprising an actuation cylinder and an actuation piston slideably disposed in the actuation cylinder, with the actuation mechanism generating actuation force at least in the first direction;

at least one return spring operably connected with the actuation mechanism and biasing the actuation mechanism in the second direction; and a pneumatic booster operably connected with the actuation mechanism and biasing the actuation mechanism in the first direction, whereby giving the driver a boost force in the first direction; and wherein:

the pneumatic booster further including a pneumatic cylinder; a pneumatic piston, slideably disposed in the pneumatic cylinder for at least part of its travel range; and a charge mechanism, whereby charging the pneumatic cylinder and balancing its pressure with pressurized air from a high-pressure gas source during at least part of an actuation cycle of the actuator;

the pneumatic booster further including a bleed mechanism, whereby bleeding off excess air from the pneumatic cylinder to a low-pressure gas sink during at least part of an actuation cycle of the actuator; and the bleed mechanism being at least one bleed passage, which becomes substantially exposed to the pressurized air in the pneumatic cylinder when the pneumatic piston travels beyond a predefined distance from an initial position, whereby bleeding off excess air.

3. An actuator, comprising a fluid driver including a housing defining a longitudinal axis and first and second directions, an actuation mechanism comprising an actuation cylinder and an actuation piston slideably disposed in the actuation cylinder, with the actuation mechanism generating actuation force at least in the first direction;

at least one return spring operably connected with the actuation mechanism and biasing the actuation mechanism in the second direction; and a pneumatic booster operably connected with the actuation mechanism and biasing the actuation mechanism in the first direction, whereby giving the driver a boost force in the first direction; and wherein:

the actuation piston dividing the inner volume of the actuation cylinder into first and second fluid spaces and being operably connected with a piston rod; and the actuation mechanism further comprising first and second ports in fluid communication with the first and second fluid spaces, respectively.

4. The actuator of claim 3, wherein the second port being alternately supplied with high-pressure and low-pressure fluid lines, through an actuation 3-way valve.

5. The actuator of claim 3, wherein the second port being supplied through a proportional 3-way valve.

6. The actuator of claim 3, wherein the first and second ports being supplied through a 4-way valve.

7. A method of controlling an actuator comprising:

(a) providing an actuator including the following components:

a driver further including a housing defining a longitudinal axis and first and second directions, an actuation mechanism capable of generating actuation force at least in the first direction, and a rod with one end operably connected with at least one part of the actuation mechanism and with the other end available for an operable connection with a load of the actuator;

at least one return spring operably connected with the rod and biasing the rod in the second direction; and a pneumatic booster further including a pneumatic cylinder, a pneumatic piston operably connected with the rod and biasing the rod in the first direction, and a charge mechanism, whereby providing a controlled fluid communication between the pneumatic cylinder and a high-pressure gas source;

(b) holding the load of the actuator to a second-direction end position with the force from the at-least-one return spring biasing in the second direction and overcoming the sum of the rest of the forces including those from the pneumatic booster and the load, without generating the actuation force in the first direction from the actuation mechanism, and with the pneumatic booster being charged through the charge mechanism to yield a substantial force in the first direction to oppose a substantial load force in the second direction;

(c) initiating the travel of the load of the actuator in the first direction by generating the actuation force in the first direction from the actuation mechanism, with the combination of the actuation force and the force from the pneumatic booster being able to overcome the sum of the rest of the forces including those from the at-least-one return spring and the load and accelerate the load in the first direction;

(d) continuing the travel in the first direction with the actuation force in the first direction at least until reaching the target stroke;

(e) initiating the return travel of the load of the actuator in the second direction at least by turning off the actuation force in the first direction so that the load is accelerated in the second direction at least by the return spring;

(f) completing the return travel with a decreasing force from the return spring and an increasing force from the pneumatic booster, whereby slowing down the load.

8. The method of claim 7, wherein:

the pneumatic booster further including a bleed mechanism, whereby providing a controlled fluid communication between the pneumatic cylinder and a low-pressure gas sink.

9. The method of claim 8, further comprising bleeding off excess air in the booster cylinder through the bleed mechanism, during at least part of the time period after the initial travel in the first direction and before near the close of the travel in the second direction, to reduce the force from the pneumatic booster.

10. The method of claim 7, wherein:

the charge mechanism including a charge orifice, whereby substantially restricting the charge flow rate.

11. The method of claim 7, wherein:

the charge mechanism including a control mechanism, whereby substantially closing off the charge flow during a substantial portion of a period when the pneumatic cylinder is not at its minimum volume.

12. The method of claim 8, wherein:

the bleed mechanism being at least one passage, which becomes exposed to the pressurized air in the pneumatic cylinder when the pneumatic piston travels beyond a predefined distance from an initial position, whereby bleeding off excess air.

13. The method of claim 7, wherein the driver being a fluid driver;

the actuation mechanism comprising an actuation cylinder, an actuation piston slideably disposed in the actuation cylinder and dividing the inner volume of the actuation cylinder into first and second fluid spaces, and first and second ports in fluid communication with the first and second fluid spaces, respectively; and the rod being a piston rod operably connected with the actuation piston.

14. The method of claim 7, wherein the driver being an electromagnetic driver;

the actuation mechanism comprising an armature chamber, an armature disposed in the armature chamber, and at least a first electromagnet on the first direction side of the armature chamber, whereby being able to pull the armature in the first direction when energized; and the rod being an armature rod operably connected with the armature.

15. The method of claim 14, further including a second electromagnet on the second direction side of the armature chamber, whereby being able to pull the armature in the second direction when energized.

* * * * *

UNITED STATES PATENT AND TRADEMARK OFFICE

CERTIFICATE OF CORRECTION

PATENT NO. : 7,536,984 B2
APPLICATION NO. : 11/787295
DATED : May 26, 2009
INVENTOR(S) : Lou

It is certified that error appears in the above-identified patent and that said Letters Patent is hereby corrected as shown below:

On title page
Item (73) ~~Assignee: LGD Technology, LLC (Plymouth, MI)~~
Assignee: SCUDERI GROUP, LLC (WEST SPRINGFIELD, MA)

Signed and Sealed this
Thirteenth Day of September, 2011

David J. Kappos

David J. Kappos
*Director of the United States Patent and Trademark Office*